US011827476B2

(12) United States Patent
Akamatsu

(10) Patent No.: US 11,827,476 B2
(45) Date of Patent: Nov. 28, 2023

(54) SHEET FEEDING DEVICE AND IMAGE FORMING APPARATUS

(71) Applicant: CANON KABUSHIKI KAISHA, Tokyo (JP)

(72) Inventor: Yuki Akamatsu, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 298 days.

(21) Appl. No.: 17/353,922

(22) Filed: Jun. 22, 2021

(65) Prior Publication Data

US 2022/0033211 A1 Feb. 3, 2022

(30) Foreign Application Priority Data

Jul. 31, 2020 (JP) ..... 2020-131029

(51) Int. Cl.

| | |
|---|---|
| ***B65H 5/06*** | (2006.01) |
| ***B65H 29/12*** | (2006.01) |
| ***B65H 29/14*** | (2006.01) |
| ***G03G 15/00*** | (2006.01) |

(52) U.S. Cl.

CPC ..... *B65H 29/14* (2013.01); *B65H 5/062* (2013.01); *G03G 15/6529* (2013.01)

(58) Field of Classification Search

CPC ..... B65H 29/125; B65H 29/14; B65H 29/12; B65H 29/52; B65H 2404/144; B65H 2404/143; B65H 2404/17; B65H 2404/1341; B65H 5/062; G03G 15/6529

See application file for complete search history.

(56) References Cited

U.S. PATENT DOCUMENTS

| | | | | |
|---|---|---|---|---|
| 9,772,589 | B2 | 9/2017 | Akamatsu | |
| 2020/0218180 | A1 | 7/2020 | Akamatsu | |
| 2021/0039909 | A1* | 2/2021 | Kubo | B65H 29/52 |

FOREIGN PATENT DOCUMENTS

| | | | |
|---|---|---|---|
| JP | 2002-280089 | A | 9/2002 |
| JP | 2010241569 | A * | 10/2010 |

* cited by examiner

*Primary Examiner* — Luis A Gonzalez
(74) *Attorney, Agent, or Firm* — Venable LLP

(57) ABSTRACT

A sheet feeding device includes a driving roller, a driven roller rotated by the rotation of the driving roller, a non-conductive feeding guide, a conductive frame, a conductive bearing and an urging member to urge the driven roller toward the driving roller. The feeding guide includes a supporting portion to displaceably support the rotation shaft in an urging direction. The frame includes a positioning portion to position the driven roller in the urging direction by contact with the rotation shaft in a state in which the driving roller is urged by the driven roller.

10 Claims, 3 Drawing Sheets

SHEET FEEDING DEVICE AND IMAGE FORMING APPARATUS

FIELD OF THE INVENTION AND RELATED ART

The present invention relates to a sheet feeding device that feeds sheets, and to an image forming apparatus which includes such a sheet feeding device, such as a copier, printer, FAX, or multifunction printer having these multiple functions.

As a conventional sheet feeding device, a configuration is provided in which a sheet is nipped and fed between a driving roller and a driven roller that is driven by the rotation of the driving roller. Patent Document 1 (Japanese Laid Open Patent Application (JP A) 2002 280089) discloses a configuration in which a rotation shaft of the driving roller is rotatably supported by a bearing, and the bearing is positioned in a frame. The sheet feeding device also includes a feeding guide that guides a feeding of sheets. As a way to accurately position the feeding guide and the driving roller when the feeding guide is mounted on the frame, a configuration is known in which the feeding guide is positioned on an outer diameter portion of the bearing that supports the driving roller.

With respect to durability, metal (conductive) members may be used for the rotation shaft, bearing, and frame of the driving roller, and with respect to cost, plastic (non-conductive) members may be used for the feeding guide. In this case, if the driving roller rotates to feed sheets, the metal rotation shaft may be charged. Charging of the rotation shaft affects a feeding behavior of a fed sheet and may cause sheet jamming, etc. For this, it is necessary to ground the rotation shaft in the configuration as described above. However, the rotation shaft of the driving roller is not grounded to the frame because the plastic feeding guide is disposed between the rotation shaft of the driving roller and the frame. Thus, conventionally, a conductive member has been provided as an additional member to ground the rotation shaft of the driving roller and the frame. However, if a conductive member is provided to ground the rotation shaft of the metal driving roller and the metal frame as described above, the number of components increases and its cost rises.

SUMMARY OF THE INVENTION

The object of the present invention is to provide a configuration capable of grounding a rotation shaft of a metal driving roller and a metal frame without increasing a number of components.

According to an aspect of the present invention, there is provided a sheet feeding device, comprising: a driving roller provided with a conductive rotation shaft and a roller portion integrally rotating with the rotation shaft; a driven roller rotated by the rotation of the driving roller and configured to nip and feed a sheet between itself and the driving roller; a non-conductive feeding guide configured to guide the feeding of the sheet; a conductive frame configured to support the feeding guide; a conductive bearing configured to rotatably support the rotation shaft of the driving roller; and an urging member configured to urge the driven roller toward the driving roller, wherein the feeding guide includes a supporting portion configured to displaceably support the rotation shaft with respect to an urging direction of the urging member, and wherein the frame includes a positioning portion configured to position the driven roller with respect to the urging direction by contact with the rotation shaft in a state in which the driving roller is urged by the driven roller.

Further features of the present invention will become apparent from the following description of exemplary embodiments (with reference to the attached drawings).

Figure 3:
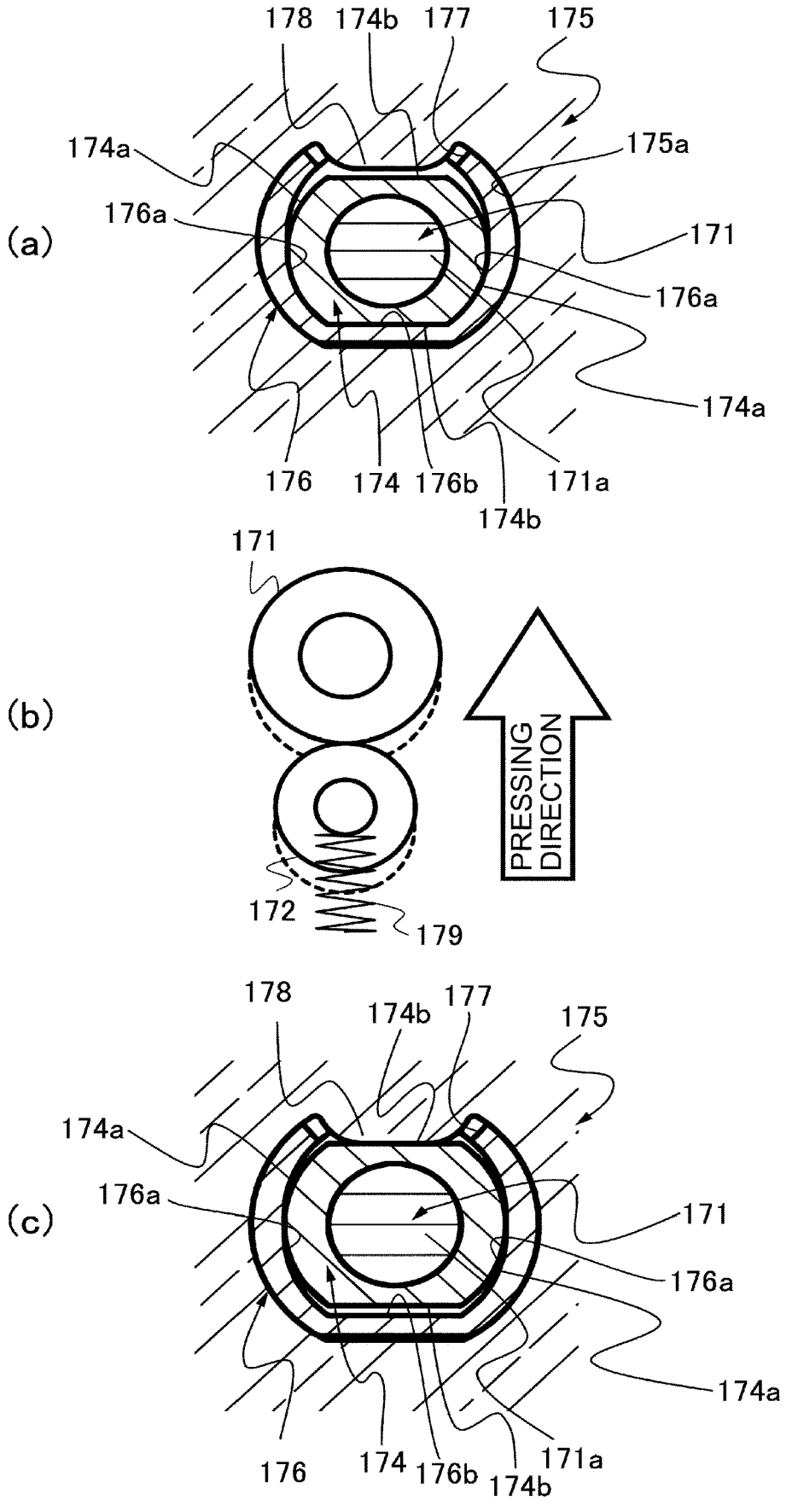

Part (a) of FIG. 3 is a sectional view of a supporting portion of a driving roller when the driving roller is not urged according to the embodiment. Part (b) of FIG. 3 is a schematic view showing an urging direction by a driven roller according to the embodiment. Part (c) of FIG. 3 is a sectional view of a supporting portion of the driving roller when the driving roller is urged according to the embodiment.

DESCRIPTION OF THE EMBODIMENTS

Figure 1:
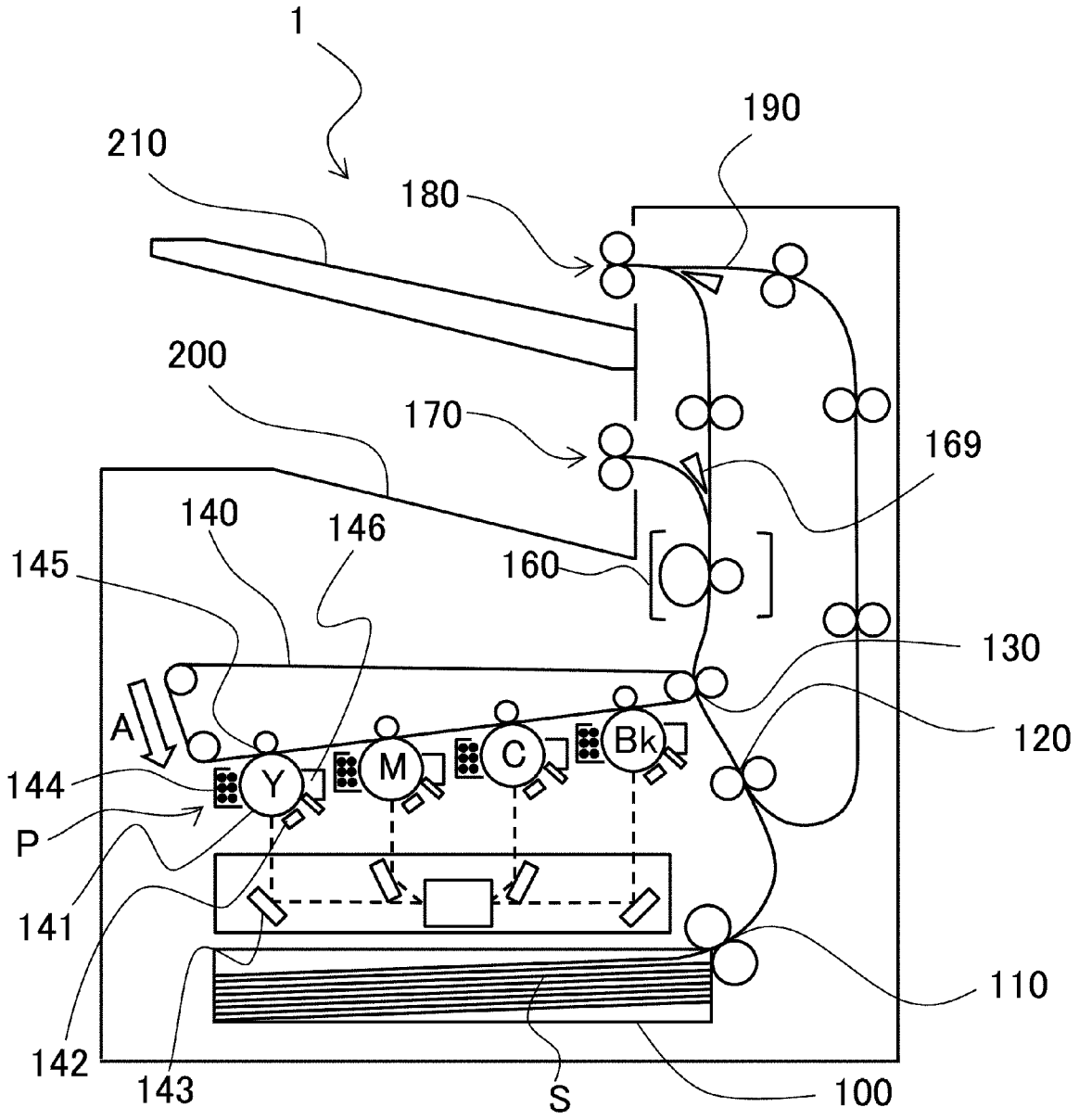
FIG. 1 is a schematic sectional view showing an image forming apparatus according to an embodiment of the present invention.

In the following, an embodiment of the present invention will be described with reference to FIG. 1 to part (c) of FIG. 3. First of all, a schematic configuration of an image forming apparatus of this embodiment will be described with reference to FIG. 1.

[Image Forming Apparatus]

An image forming apparatus 1 of this embodiment is a color printer by an electrophotographic method, and adopts an intermediary transfer tandem method in which a plurality of image forming portions P (four portions in case of this embodiment) are arranged side by side on an intermediary transfer belt 140. The image forming apparatus 1 of such a method has advantages of excellent adaptability to a wide variety of sheets S used in present day and excellent print productivity. The sheets S include sheet materials such as paper, plastic film, cloth, etc.

The sheets S are stacked in an accommodating container 100, and each is fed from a feeding portion 110 which consists of a pair of rollers in accordance with a timing of image formation. The sheets S fed by the feeding portion 110 pass through a feeding path and is fed to a registration roller pair 120, which is a pre-transfer feeding portion.

The sheet S is abutted against the registration roller pair 120, so that a loop of the sheet is formed and thus the oblique movement is rectified while following the leading edge of the sheet S. The registration roller pair 120 also has a function of feeding the sheet S to the secondary transfer portion at a predetermined timing in accordance with a timing of image formation on the sheet S, that is, a toner image born on an intermediary transfer belt 140. The registration roller pair 120 feeds the sheet S to a secondary transfer portion 130 at a desired timing, after correcting for skewness.

The secondary transfer portion 130 is a transfer nip portion of a toner image to the sheet S formed by an opposing secondary transfer inner roller and secondary transfer outer roller, and transfers the toner image onto the sheet S by applying predetermined pressure and electrostatic load bias. An image forming process, whose image is fed to the secondary transfer portion 130, will be described. The image forming process is at a similar timing of the feeding process of the sheet S to the secondary transfer portion 130 as described above.

An image forming portion P mainly consists of a photosensitive drum 141 as an image bearing member, a charging device 142, an exposure device 143, a developing device 144, a primary transfer device 145 and a drum cleaner 146, etc. The photosensitive drum 141 is a cylindrical photosensitive body and is rotationally driven. The surface of the photosensitive drum 141 is uniformly charged in advance by the charging device 142. The exposure device 143 is driven based on a signal of image information sent from a connected PC (Personal Computer) and image reading device, etc., and an exposure light is emitted to the surface of the rotating photosensitive drum 141 to form an electrostatic latent image on the surface of the photosensitive drum 141.

The electrostatic latent image formed on the photosensitive drum 141 is visualized as a toner image on the photosensitive drum 141 after toner development by the developing device 144. The toner image is transferred onto the intermediary transfer belt 140 as an image bearing body by applying predetermined pressure and electrostatic load bias by the primary transfer device 145.

A small amount of residual transfer toner remaining on the photosensitive drum 141 is collected by the drum cleaner 146 and prepared for a next image formation again. In case of FIG. 1, there are 4 sets of the image forming portion P as described above: Yellow (Y), Magenta (M), Cyan (C) and Black (Bk). However, a number of colors is not limited to four, and an order of colors is also not limited to this.

Next, the intermediary transfer belt 140 will be described. The intermediary transfer belt 140 is an endless belt and is tensioned by rollers such as driving rollers, tension rollers and secondary transfer inner rollers, and is fed in a direction of arrow A in FIG. 1. The image forming process of each color, which is sequentially processed in parallel by Y, M, C and Bk image forming portions P as described above, is performed at a timing to superimpose on toner image of upstream color(s) that has been primary transferred on the intermediary transfer belt 140. As a result, a full color toner image is finally formed on the intermediary transfer belt 140 and fed to the secondary transfer portion 130.

After the feeding process and the image forming process of the sheet S as described above, a full color toner image is secondary transferred onto the sheet S in the secondary transfer portion 130, and then the sheet S is fed to a fixing device 160. The fixing device 160 melts and fixes the toner image on the sheet S by applying a predetermined pressure by an opposing rollers or a belt, etc. and a heating effect by a heat source such as a heater, etc. in general.

The sheet S with the fixed image obtained as described above is selectively discharged to discharge trays 200 and 210 by discharging portions 170 and 180 by a branch feeding mechanism 169. In case of double-sided image formation, the rotation of the discharging portions is stopped during feeding the sheet S, and the sheet S is fed to a double-sided feeding path 190 by reversing the rotation of the discharging portions. The sheet S fed to the double-sided feeding path 190 is again fed to the secondary transfer portion 130 with the front and back sides inverted, and after the toner image is secondary transferred to the back side in the same method as described above, the toner image is fixed by the fixing device 160. Then, it is selectively discharged to the discharge trays 200 and 210. The discharging portions 170 and 180 are sheet feeding devices, both of which include a pair of rollers and have basically the same configuration. In the following, the discharging portion 170 will be described.

[Discharging Portion]

Figure 2:
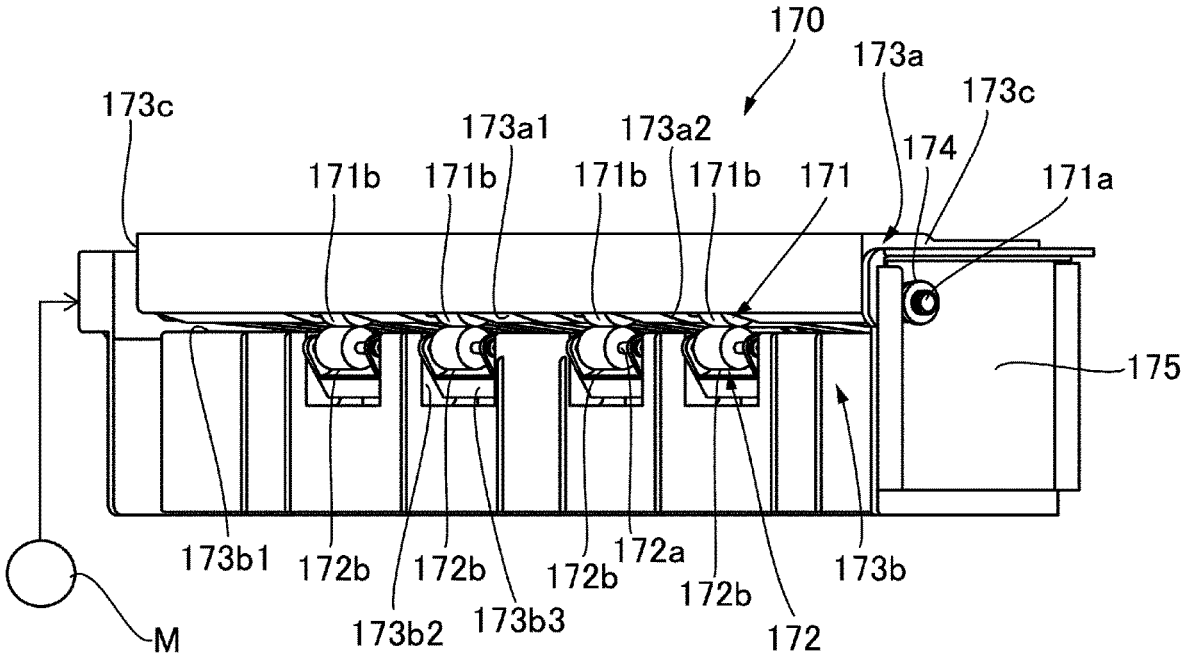
FIG. 2 is a perspective view showing a sheet discharging portion according to the embodiment.

The discharging portion (sheet discharging device) 170 will be described using FIG. 2. As shown in FIG. 2, the discharging portion 170 as a sheet feeding device includes a driving roller 171, a driven roller 172, feeding guides 173*a* and 173*b*, a conductive bearing 174, and a frame 175. The driving roller 171 is connected to a motor M as a drive source to drive to rotate. The driving roller 171 includes a rotation shaft 171*a* and a plurality of roller portions 171*b* provided around the rotation shaft 171*a*. The plurality of roller portions 171*b* are arranged at intervals in the rotation axis direction of the rotation shaft 171*a*. The rotation shaft 171*a* is a conductive member such as a metal, and the plurality of roller portions 171*b* are made of an elastic material such as a rubber. Conductive materials in this embodiment are generally defined as materials with a surface electric resistance of $10^7$ ohm or less.

The driven roller 172 rotates in accordance with the driving roller 171, and nips and feeds the sheet between the driven roller 172 and the driving roller 171. That is, the sheet is discharged into the discharge tray 200 (FIG. 1) by nipping and feeding the sheet between the driving roller 171 and the driven roller 172. The driven roller 172 includes a rotation shaft 172*a* and a plurality of roller portions 172*b* provided around the rotation shaft 172*a*. The plurality of roller portions 172*b* are arranged at intervals in the rotation axis direction of the rotation shaft 172*a*. The rotation shaft 172*a* is a conductive member such as a metal, and the plurality of roller portions 172*b* are made of an elastic material such as a rubber. The plurality of roller portions 172*b* of the driven roller 172 contact with the plurality of roller portions 171*b* of the drive roller 171 to form a feeding nip portion that nips and feeds the sheet.

The driven roller 172 is urged toward the driving roller 171 by a spring 179 (part (b) of FIG. 3) as an urging member. In this embodiment, since the driven roller 172 is arranged below the driving roller 171 with respect to a gravity direction, an urging direction by the spring 179 is upward in the gravity direction. Thus, the driven roller 172 is supported by a movable arm 173*b*3 so that it can move in the urging direction (upward and downward direction in this embodiment).

The feeding guides 173*a* and 173*b* guide the feeding of the sheet, and are arranged on both sides of the sheet, fed by the driving roller 171 and the driven roller 172. The feeding guides 173*a* and 173*b* are made of a non-conductive plastic material. The feeding guide 173*a* includes a guide surface 173*a*1 opposing one side of the sheet (a top side of the sheet in case of FIG. 2) and guides one side of the sheet fed by the driving roller 171 and the driven roller 172.

As for the feeding guide 173*a*, the driving roller 171 is arranged inside, and a plurality of through holes 173*a*2 are formed on the guide surface 173*a*1 to expose a part of the plurality of roller portions 171*b* of the driving roller 171. That is, the through holes 173*a*2 as an arrangement portions are such that the roller portions 171*b* of the driving roller 171 are arranged so that a part of the roller portions 171*b* protrude more toward the driven roller side than the guide surface 173*a*1.

The feeding guide 173*b* includes a guide surface 173*b*1 opposing the other side of the sheet (the bottom side of the sheet in case of FIG. 2) and guides the other side of the sheet fed by the driving roller 171 and the driven roller 172. As for the feeding guide 173*b*, a plurality of recessed portions 173*b*2 are formed so that the plurality of roller portions 172*b* of the driven roller 172 can move in up and down direction. The plurality of recessed portions 173*b*2 are opened on the plurality of guide surfaces 173*b*1 to allow a part of the plurality of roller portions 172*b* to protrude more toward the driving roller side than the guide surface 173*b*1.

A bearing 174 is conductive and rotatably supports the driving roller 171. That is, the edge portion of the rotation shaft 171*a* of the driving roller 171 is rotatably supported with respect to the feeding guide 173*a*. The frame 175 is a frame of a device and is arranged to oppose side portions 173*c* on both sides of the rotation axis direction of the driving roller 171 and the driven roller 172 of the feeding guides 173*a* and 173*b*, and supports the feeding guides 173*a* and 173*b*. Thus, the driving roller 171 and the driven roller 172 are supported by the frame 175 via the feeding guides 173*a* and 173*b*.

[The Support Structure of the Driving Roller]

The detailed support structure of the driving roller 171 will be described in FIG. 3, parts (a) to (c). The feeding guide 173*a* is provided with a fitting cylinder portion 176 as a supporting portion which supports the bearing 174 to be freely displaceable in the urging direction of the spring 179. The fitting cylinder portion 176 is a cylindrical shaped protrusion, protruding in the rotation axis direction of the driving roller 171, from the side portions 173*c* of the feeding guide 173*a* toward the frame 175. The fitting cylinder portion 176 is formed integrally with the feeding guide 173*a* in plastic material and is non-conductive as same as the feeding guide 173*a*.

The fitting cylinder portion 176 is provided with a pair of support surfaces 176*a* on both sides of the bearing 174 with respect to the sheet feeding direction (left and right direction in FIG. 3, parts (a) to (c)) fed by the driving roller 171. The pair of support surfaces 176*a* allow the bearing 174 to move in the urging direction while positioning the bearing 174 with respect to the feeding direction.

The fitting cylinder portion 176 is also provided with a restriction surface 176*b* on the side of the driven roller 172 side with respect to the urging direction of the spring 179, and on the side opposing the bottom of the bearing 174 in this embodiment. The restriction surface 176*b* is a surface that restricts the bearing 174 from moving further in a predetermined position in the direction opposite to the urging direction (downward) while the driving roller 171 is not urged by the driven roller 172 (part (a) of FIG. 3).

The outer peripheral surface of the portion, which is supported by the fitting cylinder portion 176, of the bearing 174, is an arc-shaped curved surface 174*a* concentric with the rotation shaft 171*a* on both sides in the feeding direction and a flat surface 174*b* perpendicular to the urging direction on both sides in the urging direction. The outer peripheral surface of the portion of the bearing 174 may be a cylindrical surface over the entire periphery.

The pair of support surfaces 176*a* of the fitting cylinder portion 176 have curved surfaces with a larger radius of curvature than the curved surface 174*a* of the bearing 174, so that the support surfaces 176*a* and the curved surface 174*a* opposing each other can slidably move in the urging direction (in up and down direction in this embodiment). That is, the pair of support surfaces 176*a* have a long round hole shape in up and down direction and abut the curved surfaces 174*a* on both sides of the bearing 174, so that the bearing 174 to move in up and down direction along the pair of support surfaces 176*a*. The restriction surface 176*b* is a flat surface perpendicular to the pressing direction, and by contacting the lower flat surface 174*b* of the bearing 174, the bearing 174 is prevented from moving downward any further.

The fitting cylinder portion 176 includes the pair of support surfaces 176*a* and the restriction surface 176*b* in the inner peripheral surface. The pair of support surfaces 176*a* abut with the curved surfaces 174*a* on both sides of the bearing 174 to position the bearing 174 with respect to the sheet feeding direction. On the other hand, if the driving roller 171 is not urged by the driven roller 172, the restriction surface 176*b* abuts with the lower flat surface 174*b* of the bearing 174. This restricts the movement of the driving roller 171 in the direction of gravity at a predetermined position so that the driving roller 171 does not move too far toward the driven roller 172 side by its gravity.

The fitting cylinder portion 176 has a notched portion 177 which is partially notched on the opposite side (upper side) of the restriction surface 176*b* with respect to the urging direction. On the other hand, a through hole 175*a* is formed in the frame 175, and the feeding guide 173*a* is positioned in the frame 175 by fitting the outer periphery of the fitting cylinder portion 176 into the through hole 175*a*.

The frame 175 is provided with a positioning protrusion 178 as a positioning portion, which positions the bearing 174 in the urging direction while the driving roller 171 is urged by the driven roller 172 (as shown in part (c) of FIG. 3). Since the positioning protrusion 178 is an integrated member with the frame 175, it is electrically conductive as same as the frame 175.

In this embodiment, the positioning protrusion 178 is formed so that it protrudes from a part of the inner peripheral surface of the through hole 175*a*, and it enters into the notched portion 177 of the fitting cylinder portion 176 while the fitting cylinder portion 176 is fitted into the through hole 175*a*. If the driving roller 171 is urged by the driven roller 172 and the bearing 174 moves in the urging direction inside the fitting cylinder portion 176, the positioning protrusion 178 abuts the upper flat surface 174*b* of the bearing 174. Then, it restricts the driving roller 171 from moving in the urging direction any further. As a result, the driving roller 171 is positioned with respect to the urging direction.

As shown in FIG. 2, the driving roller 171 is drivingly connected to the motor M on one side in the rotation axis direction. One side in the rotation axis direction is the back side (rear side) of the image forming apparatus 1 in this embodiment. The back side of the image forming apparatus 1 is the opposite side of the front side, in the case that the side on which the apparatus is operated (for example, the side on which an operation panel is located) is the front side. In this embodiment, the fitting cylinder portion 176 is arranged on the other side (the front side) of the rotation axis direction of the driving roller 171. This is because the side connected to the motor M, for example, connects a driving shaft of the motor M and the rotation shaft 171*a* of the driving roller 171 via a gear train, and the rotation shaft 171*a* is designed to position by a separate configuration. A grounding between the rotation shaft 171*a* and the frame 175 is sufficient if one end of the rotation shaft 171*a* is grounded, so it is not necessary to have the configuration as described above for the side connected to the motor M. However, the same configuration may be used for the side connected to the motor M.

Operations before and after urging by the driven roller 172 will be specifically described below. As shown in part (a) of FIG. 3, if the driving roller 171 is not urged by the driven roller 172 at the time of non-urging, the bearing 174 is separated from the positioning protrusion 178 in the fitting cylinder portion 176 by the effect of gravity, and the lower flat surface 174*b* is abutted with the restriction surface 176*b*. As shown in part (b) of FIG. 3, if the driven roller 172 is urged in the direction of the driving roller 171, the driving roller 171 moves in the urging direction, and the conductive bearing 174 attached to the end of the rotation shaft of the driving roller 171 also moves in the fitting cylinder portion 176 accordingly.

As shown in part (c) of FIG. 3, the upper flat surface 174*b* of the bearing 174 abuts against the positioning protrusion 178, which is part of the frame 175, and the movement of the bearing 174 is restricted. If the driving roller 171 is urged by the driven roller 172 at the time of urging, the conductive bearing 174 butts against the positioning protrusion 178 which is part of the conductive frame body 175. Thus, the driving roller 171 becomes grounded to the frame 175. In this state, the bearing 174 is positioned in the sheet feeding direction within the fitting cylinder portion 176 and is also positioned in the urging direction by the driven roller 172 by abutting with the positioning protrusion 178. That is, the driving roller 171 is positioned both in the sheet feeding direction and in the urging direction of the spring 179 via the bearing 174.

In the case of the present invention configured as described above, the driving roller 171 can be grounded while ensuring a positioning accuracy of the driving roller 171 relative to the feeding guide 173*a*. That is, since the driving roller 171 is urged by the driven roller 172, if the positioning accuracy with respect to the feeding guide 173*a* is low, the driving roller 171 may not protrude sufficiently from the guide surface 173*a*1. Especially, it is required to improve a sheet feeding force to meet various types of media. So it may be achieved by increasing the urging force of the driven roller against the driving roller. In this case, depending on the positioning accuracy with respect to the feeding guide which guides the sheet feeding by a warp of the driving roller, the driving roller may not be able to protrude sufficiently from the guide surface of the feeding guide. If the driving roller 171 does not protrude sufficiently from the guide surface 173*a*1 of the feeding guide 173*a*, there is a concern that the sheet, nipped and fed by the driving roller 171 and the driven roller 172, may scratch the guide surface 173*a*1 and cause a jam.

In this embodiment, the bearing 174 is supported in the fitting cylinder portion 176 of the feeding guide 173*a* to be freely displaceable in the urging direction, and if the driving roller 171 is urged by the driven roller 172, the bearing 174 is abutted with the positioning protrusion 178 of the frame 175. As a result, the driving roller 171 is positioned in the urging direction. Since the configuration is such that the driving roller 171 is positioned in the urging direction by being urged, the driving roller 171 is positioned with high accuracy regardless of the urging force by the driven roller 172.

In addition, in this embodiment, the rotation shaft 171*a* of the driving roller 171 and the frame 175 are grounded without increasing the number of components. That is, since the frame 175 which includes the bearing 174 and the positioning protrusion 178 is conductive, the driving roller 171 is grounded if the bearing 174 is abutted with the positioning protrusion 178. Thus, the conductive bearing 174 can be abutted with the conductive frame 175 without increasing the number of components and it is possible to reduce the number of conductive components for grounding.

In the case of the configuration as described in Patent Document 1, a grounding plate is inserted between the bearing and the frame to ground the driving roller. In the case of the configuration in which the grounding plate is inserted between the bearing and the frame, depending on how the grounding plate is installed, there is a possibility that the bearing may be tilted due to an extra external force applied to the bearing. In this case, the rotation shaft of the roller may wear unevenly, or a driving torque of the roller may increase. On the other hand, in the case of this embodiment, no components such as a grounding plate are added as described in Patent Document 1, so it is possible to suppress an excessive external force applying to the bearing 174 due to mounting errors etc. As a result, the bearing 174 can be suppressed from an even wear by tilting due to external force or an increase the driving torque of the driving roller 171.

If the bearing 174 is unevenly worn, the wear debris formed in the process accumulates between the rotation shaft 171*a* of the driving roller 171 and the conductive bearing 174. If the wear debris is fixed, the rotation of the driving roller 171 may stop (lock) and a sheet jam may occur. However, in this embodiment, such wear debris is less likely to be formed, so the rotation of the driving roller 171 is less likely to be stopped by the wear debris.

OTHER EMBODIMENTS

In the embodiment as described above, the case that the sheet feeding device of the present invention is applied to the discharging member was described. However, the sheet transfer device of the present invention can also be applied to a feeding portion that feeds sheets from a storage compartment into the apparatus and to other portions that feed sheets. The sheet feeding device can also be applied to apparatus other than image forming apparatus. For example, it can also be applied to portions that feed sheets, such as an image reading device which reads images on a sheet while the sheet is being fed, a sheet processing device which applies stapling or other processing on a sheet, and a sheet feeding device which is separate body from an image forming apparatus and feeds sheets to the image forming apparatus.

In the embodiment as described above, in order to position the driving roller 171 in the urging direction, the configuration is that the fitting cylinder portion 176 as a supporting portion is fitted to the through hole 175*a* of the frame 175 and the positioning protrusion 178 enters into the notched portion 177 which is formed in the fitting cylinder portion 176. However, if the feeding guide 173*a* is positioned on the frame 175 at another portion, the supporting portion does not need to be fitted into the through hole of the frame 175. In this case, a positioning portion is provided in the frame 175 to restrict the movement of the bearing in the supporting portion in the urging direction, such as in the vicinity of the supporting portion.

In the embodiment as described above, the position of the bearing 174 in the sheet feeding direction and the position of the bearing 174 in the urging direction are determined by the fitting cylinder portion 176, however, the position of the bearing 174 in the sheet feeding direction may be determined by a separate portion from the supporting portion that supports the bearing to be freely displaceable in the urging direction. The supporting portion and the feeding guide may be separate, and the positioning portion and the frame may be separate. Furthermore, as long as the feeding guide guides the sheet fed by the driving roller, the feeding guide may have a configuration which does not include arrangement portions to arrange the roller portions of the driving roller. For example, it may have a configuration which include arrangement portions only on the upstream side or only on the downstream side of the driving roller in the sheet feeding direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-131029 filed on Jul. 31, 2020, which is hereby incorporated by reference herein in its entirety.

What is claimed is:

1. A sheet feeding device comprising:

a driving roller provided with a conductive rotation shaft and a roller portion integrally rotating with said rotation shaft;

a driven roller rotated by the rotation of said driving roller and configured to nip and feed a sheet between itself and said driving roller;

a non-conductive feeding guide configured to guide the sheet;

a conductive frame configured to support said feeding guide;

a conductive bearing configured to rotatably support said rotation shaft of said driving roller; and an urging member configured to urge said driven roller toward said driving roller, wherein said feeding guide includes a supporter configured to displaceably support said bearing with respect to an urging direction of said urging member, and wherein said frame includes a positioner configured to position said driving roller with respect to the urging direction by contact with said bearing in a state in which said driving roller is urged by said driven roller.

2. A sheet feeding device according to claim 1, wherein said feeding guide further includes a guide surface for guiding the sheet, and wherein said roller portion is arranged so that a part of said roller portion protrudes toward a side of said driven roller more than the guide surface.

3. A sheet feeding device according to claim 1, wherein said supporter includes a pair of supporting surfaces provided on both sides of said rotation shaft with respect to a feeding direction of the sheet by said driving roller, configured to position said bearing with respect to the feeding direction and to permit said bearing to move with respect to the urging direction.

4. A sheet feeding device according to claim 1, wherein said supporter includes a restriction surface configured to restrict further movement of said rotation shaft from a predetermined position to a direction opposite to the urging direction in a state in which said driving roller is not urged by said driven roller.

5. A sheet feeding device according to claim 4, wherein said supporter includes a cylindrical protruding portion protruded from said feeding guide, including the pair of supporting surfaces and the restriction surface in an inner peripheral surface thereof, and a notched portion by being partially notched thereof on a side opposite to the restriction surface with respect to the urging direction, and wherein said positioner is configured to enter into said notched portion.

6. A sheet feeding device according to claim 5, wherein said frame includes a through hole, wherein said feeding guide is positioned to said frame by an outer peripheral surface of said supporter being fitted in said through hole, and wherein said positioner is configured to be protruded from a part of the inner peripheral surface of said through hole.

7. A sheet feeding device according to claim 1, wherein said driven roller is arranged under said driving roller with respect to a gravity direction.

8. A sheet feeding device according to claim 1, wherein one side of said driving roller is drivingly connected to a driving source with respect to a rotational axis direction, and wherein said supporter is arranged on the other side of said driving roller with respect to the rotational axis direction.

9. An image forming apparatus comprising:

an image forming portion configured to an image on a sheet; and a sheet feeding device according to claim 1.

10. An image forming apparatus, according to claim 9, wherein said sheet feeding device further includes a discharging portion configured to discharge the sheet on which the image is formed by said image forming portion.

* * * * *